US010485084B2

(12) United States Patent
Larkin, Sr. et al.

(10) Patent No.: US 10,485,084 B2
(45) Date of Patent: Nov. 19, 2019

(54) STATIC ELIMINATOR

(71) Applicant: Alpha Innovation, Inc., Marblehead, MA (US)

(72) Inventors: William J. Larkin, Sr., Marblehead, MA (US); William J. Larkin, Jr., Marblehead, MA (US)

(73) Assignee: Alpha Innovation, Inc., Marblehead, MA (US)

( * ) Notice: Subject to any disclaimer, the term of this patent is extended or adjusted under 35 U.S.C. 154(b) by 162 days.

(21) Appl. No.: 15/274,318

(22) Filed: Sep. 23, 2016

(65) Prior Publication Data

US 2017/0094760 A1 Mar. 30, 2017

Related U.S. Application Data

(60) Provisional application No. 62/233,343, filed on Sep. 26, 2015.

(51) Int. Cl.
*H05F 3/06* (2006.01)
*H05F 3/02* (2006.01)

(52) U.S. Cl.
CPC *H05F 3/06* (2013.01); *H05F 3/02* (2013.01)

(58) Field of Classification Search
CPC ..... H05F 3/06; H05F 3/02
(Continued)

(56) References Cited

U.S. PATENT DOCUMENTS 3,904,929 A 9/1975 Kanaya et al.
4,263,636 A * 4/1981 Testone ..... H05F 3/04 250/423 R (Continued)

FOREIGN PATENT DOCUMENTS

DE 2343483 3/1975
EP 2826520 1/2015
GB 2004476 A * 4/1979 ..... B65D 65/38

OTHER PUBLICATIONS

International Search Report and Written Opinion, PCT/US2016/053384, dated Nov. 30, 2016.

(Continued)

*Primary Examiner* — Kevin J Comber
(74) *Attorney, Agent, or Firm* — Antoinette G. Giugliano; Antoinette G. Giugliano PC

(57) ABSTRACT

The present invention relates to a protective ionizing laminate (PIL) static eliminating device that uses a wide variety of laminate materials to protect ionizing points that eliminate static. In an embodiment, the protective encasement is made from laminate and in others it is made from a substrate onto which of electrically conductive or static dissipative material is printed or placed. The present invention includes a plurality of electrically conductive or static dissipative material or microfibers, wherein the plurality of electrically conductive or static dissipative material or microfibers forms a pattern and a ground in communication with the electrically conductive or static dissipative microfibers or material. The laminate materials form an encasement or enclosure of the electrically conductive or static dissipative microfibers or material and at least a portion of the ground. The PIL of the present invention includes an edge or slit in the enclosure that exposes the plurality of electrically conductive or static dissipative material or microfibers at the edge or slit to create a series of ionizing points. When air between the ionizing points and charged material passes by or near the PIL static eliminating device, the PIL sufficiently removes or reduces static charge from the passing material.

20 Claims, 9 Drawing Sheets

(58) Field of Classification Search
USPC ..... 361/213
See application file for complete search history.

(56) References Cited

U.S. PATENT DOCUMENTS

| | | | | |
|---|---|---|---|---|
| 4,525,398 | A * | 6/1985 | Rooklyn | H05F 3/025 428/332 |
| 5,501,899 | A | 3/1996 | Larkin, Sr. | |
| 5,690,014 | A | 11/1997 | Larkin, Sr. | |
| 5,737,176 | A | 4/1998 | Muz | |
| 5,740,006 | A | 4/1998 | Larkin, Sr. | |
| 6,522,077 | B2 | 2/2003 | Larkin, Sr. | |
| 6,750,164 | B2 | 6/2004 | Larkin, Sr. | |
| 7,684,169 | B1 | 3/2010 | Larkin, Sr. | |
| 2003/0202830 | A1 | 10/2003 | Oh et al. | |
| 2014/0078637 | A1 | 3/2014 | Robinson | |

OTHER PUBLICATIONS

International Preliminary Report on Patentability, Application No. PCT/US2016/053384, dated Apr. 5 2018.
Communication pursuant to Article 94(3) EPC, EP application No. 16784301, Mailed Jan. 22, 2019.

* cited by examiner

STATIC ELIMINATOR

RELATED APPLICATION

This application claims the benefit of U.S. Provisional Application No. 62/233,343, entitled, "Static Eliminator" by William J Larkin, Sr, filed Sep. 26, 2015.

The entire teachings of the above application(s) are incorporated herein by reference.

BACKGROUND OF THE INVENTION

Prior to the present invention, certain limitations of static eliminators exist. Static eliminators have ionizing points that act to ionize the charge on material passing by them, in order to remove the static charge from the material. Static eliminators are used in a number of different industries that utilize machines that generate static charge. Such industries include, for example, the printing industries, the packaging industries, the paper industries, the textile industries, the plastics industries, the converting industries, the manufacturing industries, and the like. Examples of such static eliminators with potential limitations include static eliminating brushes, tinsel, cords, fabric, larger point or wire assemblies and various powered static eliminating devices and equipment. Passive static eliminators such as tinsel, conductive and static dissipative brushes, conductive cords and conductive fabric can sometimes result in contamination from the slivers and/or thin strips, fibers and pieces that can break off. They can hold and hide contamination and be difficult to clean and wash, whereas larger wires assemblies are generally less efficient with respect to ionization because their points tend to be larger and less sharp and if sharpened, the points make them a skin puncture hazard for operators. Generally, passive ionizing points are made from fibers that get dirty, damaged or matted down while in use. Eventually, the fibers become less efficient at ionizing the charge. Additionally, these fine fibers sometimes break away from the static eliminator and get accidently caught into the machine which could damage the machine, or mix into product that the machine is producing which contaminates the product. There are many other industries such as food, clean rooms, medical or pharmaceutical industries that would benefit from static eliminators that cannot contaminate, lose material, hide foreign material and that could be cleaned, washed, treated, sterilized, etc. However, often these fibers can hide and hold foreign material, are difficult to clean and cannot be adapted to the requirements of the application.

Hence, a need exists for a static eliminator that protects these fibers and reduces the damage done to the fibers. A further need exists for static eliminators that allow these fibers to be effective for longer periods of time, as compared to non-protected or less-protected fibers. It would be advantageous to develop a static eliminator that is durable and can be washed, cleaned and/or sterilized depending on its particular application. Yet, another need exists for creating a static eliminator that has characteristics for the environment for which it is being used e.g., in high heat, cold, chemical exposure, abrasion, treatments, vibration, and the like.

SUMMARY OF THE INVENTION

The present invention relates to a protective ionizing laminate (PIL) static eliminating device. In an embodiment, the device has at least two laminate layers; a plurality of electrically conductive or static dissipative material (e.g., conductive ink) or microfibers, and a ground in communication with the electrically conductive or static dissipative material or microfibers (e.g., pathways). The plurality of electrically conductive material or microfibers forms a conductive or static dissipative pattern. When the laminate layers are laminated together, the electrically conductive or static dissipative material or microfibers and the ground are positioned there between. In this embodiment, this forms a laminated enclosure. The PIL of the present invention has an edge in the laminated enclosure that exposes the plurality of electrically conductive or static dissipative material/microfibers at the edge to create a series of ionizing points. The creation of this edge and ionizing points creates the static eliminating device so that the air between the ionizing points and charged material passing by or near the PIL static eliminating device is sufficiently ionized to remove or reduce static charge from the passing material. The laminated layers can be laminated to one another by heat, pressure, welding, adhesives or the like. The pattern of conductive or static dissipative material can be made from fibers, wires, threads, yards, and printed conductive lines. The conductive or static dissipative material/microfibers are pathways that have a diameter between about 100 nm and about 50 μm. In one aspect, the pattern of conductive or static dissipative material/microfibers are made from metal, carbon, metal coated carbon, copper, silver, gold, stainless, tungsten, steel, graphene, metal coated acrylic, metallized acrylic, conductive polymers including, inks and jetted conductive materials, composite materials, static dissipative polymers or a combination thereof. In another aspect, the ground is made from metallized protective material, a conductive material, or static dissipative protective material. Examples of the ground include conductive material such as a conductive fiber or strip, a conductive bar, conductive wire, conductive foil, or a conductive rod. The thickness of the laminate range between about 5 μm to about 300 μm, and the profile of the PIL ranging between about 5 μm to about 500 μm. In certain embodiments, the static eliminating device is cut or dye-cut into a desired shape. The laminate layers can be made from a variety of commercially available laminate materials, in certain aspects they can be made from, e.g., polyester film, para-aramid tape, polyolefin, polypropylene, polyimide, polyvinyl chloride, acetate, polytetrafluoroethylene, polyethylene terephthalate, rubber material, cellulous material, or metallized materials and films.

In another embodiment, the PIL of the present invention can have one layer and can be dispensed, like a piece of tape from a roll, and placed on a machine or part so that the surface provides protection and grounding for the conductive or static dissipative pattern of points which ionizes the air between themselves and charged material passing nearby. Accordingly, in an embodiment, the device has at least one laminate layer for attachment to a machine or part; a plurality of electrically conductive or static dissipative material/microfibers, and a ground in communication with the electrically conductive or static dissipative material/microfibers (e.g., pathways). The plurality of electrically conductive or static dissipative material/microfibers forms a pattern. When the laminate layers are attached to the machine or part, the electrically conductive or static dissipative materials/microfibers and the ground are positioned there between. This forms a laminated enclosure. Additionally, the PIL of the present invention can include a release liner which is removed when the laminate layer is attached to a machine or part which provides protection and grounding.

In yet another embodiment, the PIL static eliminating device has a first laminate layer having a first protective surface and a first lamination surface; a plurality of electrically conductive or static dissipative material/microfibers attached to the first lamination surface of the first laminate layer, wherein the plurality of electrically conductive or static dissipative material/microfibers form a pattern; a ground in communication with the electrically conductive or static dissipative microfibers; an optional second laminate layer having a second protective surface and a second lamination surface; wherein the first lamination surface and the second lamination surface are laminated to one another with the electrically conductive or static dissipative material/microfibers and at least a portion of the ground positioned there between to thereby form a laminated enclosure; and an edge in the laminated enclosure that exposes the plurality of electrically conductive or static dissipative material/microfibers at the edge to create a series of ionizing points to thereby obtain a protective ionizing laminate static eliminating device. In the case in which the PIL of the present invention has one laminate layer, the first lamination surface is attached to the machine or part with the electrically conductive or static dissipative material/microfibers and at least a portion of the ground positioned there between to thereby form a laminated enclosure with the machine. The air between the ionizing points and charged material passing by or near the protective ionizing laminate static eliminating device is sufficiently ionized by the PIL to remove or reduce static charge from the passing material.

The present invention includes systems, apparatus or machines that include the PIL described herein and the system, apparatus or machine that is adapted to receive the static eliminating device, wherein the static eliminating device is positioned proximal to or on a surface at which insulative material flows or propels.

The present invention further involves methods for using the PIL. In an embodiment, the methods include subjecting the PIL described herein to charged material (e.g., the charged material passes by or near the PIL static eliminating device) such that the air between the ionizing points and charged material is sufficiently ionized to remove or reduce static charge from said material. In an embodiment, the PIL is positioned underneath or proximal to insulative material being propelled.

The present invention involves static eliminating device kits for installation on a machine or apparatus. In an embodiment, the kit includes the pieces and parts described herein. In a particular embodiment, the kit includes a first laminate layer having a first protective surface and a first adhesive surface with an adhesive coating; a plurality of electrically conductive or static dissipative material/microfibers attached to the first adhesive surface of the first laminate layer, wherein the plurality of electrically conductive or static dissipative material/microfibers form a pattern; a ground in communication with the electrically conductive or static dissipative material/microfibers and covered in part with a release liner; an optional second laminate layer having a second protective surface and a second lamination surface; wherein the first adhesive surface and the second lamination surface are attached to one another with the electrically conductive or static dissipative material/microfibers and at least a portion of the ground positioned there between to thereby form a laminated enclosure; and an edge in the laminated enclosure that exposes the plurality of electrically conductive or static dissipative material/microfibers at said edge to create a series of ionizing points to thereby obtain a protective ionizing laminate static eliminating device. When the PIL static eliminating device is installed, the release liner is removed from the ground and is placed on the machine or apparatus.

The advantages of the present invention are numerous. The present invention provides a PIL static eliminator that is durable and protects the conductive fibers during use. Additionally, the PIL static eliminator has a laminate encasement that allows for the static eliminator to be washed, cleaned and/or sterilized. An embodiment of the PIL of the present invention provides ionizing points and small edges configured to effectively ionize the static charge and reduce the capacitance along the edge/slit. Furthermore, the PIL of the present invention can be cut (e.g., dye-cut), formed, configured and/or shaped to fit in many types of spaces within a machine, kit, apparatus, device, packaging, and the like. Furthermore, the PIL can be comprised of materials that suit the intended use allowing the PIL to be sterilized, made aseptic, washed, immersed or exposed to inks, solvents, paints, dyes, coatings, exposed treatments, to extreme high and low temperature, in vacuum, in space, and the like.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 1B shows a perspective view, FIG. 1C shows a side view and FIG. 1D shows a detailed side view (not to scale).

FIG. 8A shows a die cut PIL, FIG. 8B shows a conically shaped PIL, FIG. 8C shows a cylindrically shaped PIL, FIG. 8D shows cut strips of a PIL that can be used singularly, gathered into yarn, braided or sewn (FIG. 8E).

DETAILED DESCRIPTION OF THE INVENTION

A description of preferred embodiments of the invention follows.

The PIL of the present invention provides an ionizing edge of conductive points (e.g., separate or continuous) grounded to electrically conductive or static dissipative material/microfibers that are encased in a laminate material. The laminate material protects the fibers and the edge provides ionizing points capable of neutralizing static charge on an insulative material on or near its surface.

Figure 1A:
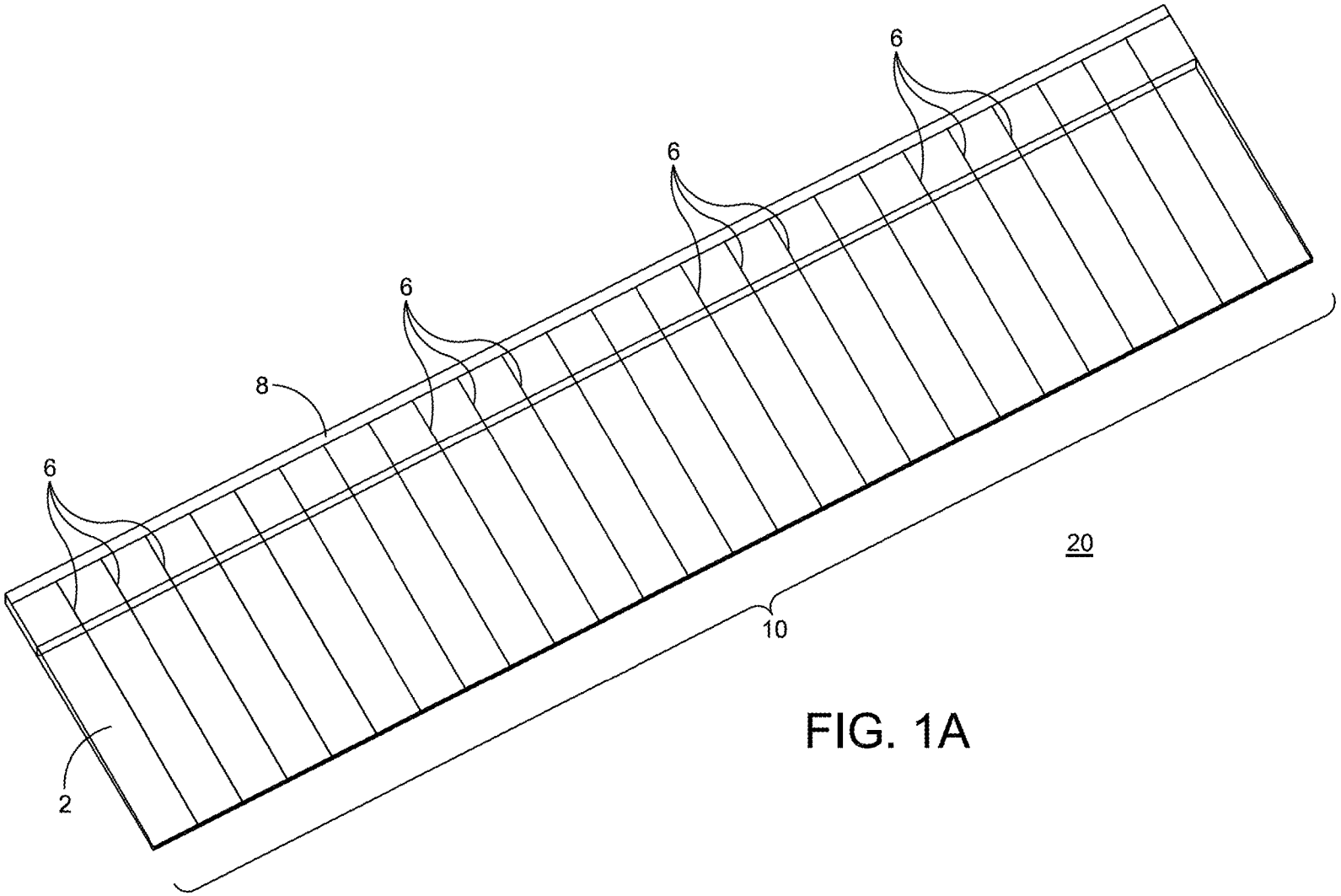
FIG. 1A is a drawing showing a perspective view of the PIL of the present invention having two laminated layers, conductive material/microfibers, and a ground. The ionizing points reside at the edge.
Figure 1B:
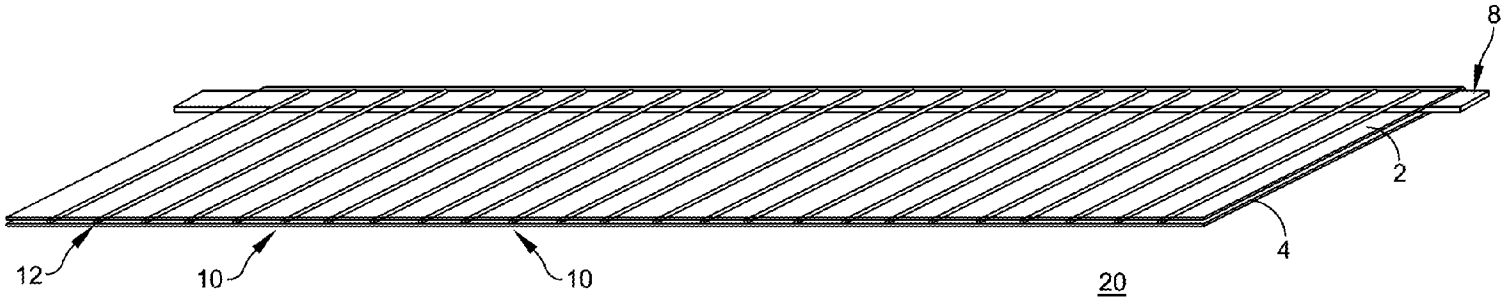
FIGS. 1B-D show a graphical representation of the PIL in FIG. 1A.

Laminate Layers/Substrates of Insulative or Anti-static Material:

Referring to FIGS. 1A and 1B, the PIL device 20 includes two laminate layers, a plurality or mesh of conductive or static dissipative material or microfibers (e.g., pathways), a ground in electrical communication with the conductive or static dissipative material or microfibers, and edge 10 which is cut to create a series of ionizing points 12. The PIL device of the present invention can include one or two or more laminate layers. In the case of two laminate layers, the layers are used to sandwich the material/microfibers, ground, etc. In the case of a single laminate layer, the single laminate layer has an adhesive material which adhere the material/microfibers, ground, etc. and are positioned between the laminate layer and the machine or device for which the PIL is used. FIGS. 1A-1B show a perspective view of the PIL 20 with two laminate layers, 2 and 4. Laminate layer 2 is the top layer and is laminated to laminate layer 4 with an adhesive. In an embodiment, the PIL can include two or more layers of laminate. In a certain embodiment, multiple layers of laminate can be used.

Figure 3:
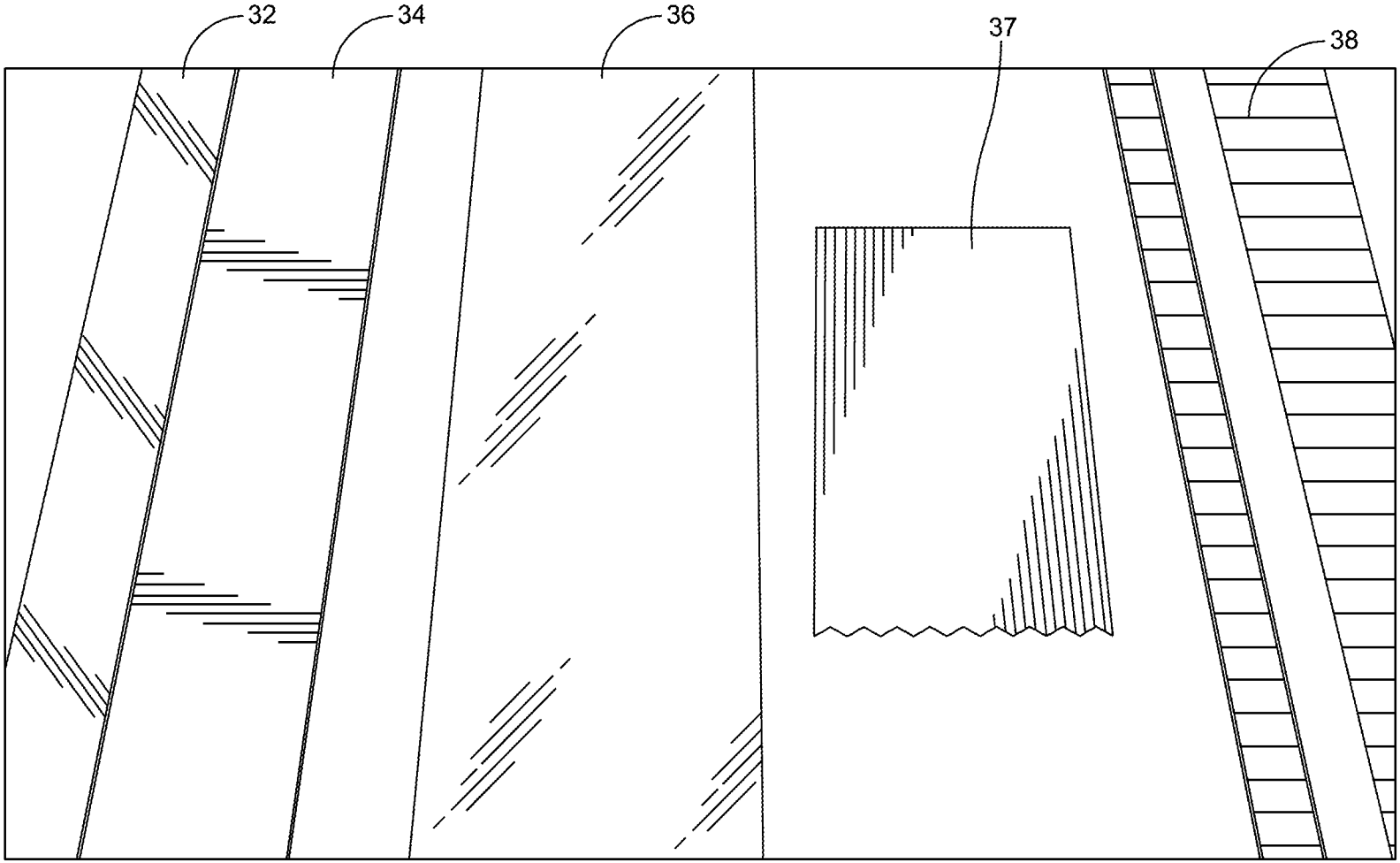
FIG. 3 is a schematic of sample materials that can be used as a laminate in making the PIL of the present invention.

The laminate layers (also referred to as "laminates" or "protective layers") refer to laminate pieces that can be attached to or united with another such piece or to the machine or device on which the PIL is being used. The laminate layers can be laminated in any number of ways. For example, the laminate layers can adhere to one another with the use of an adhesive. Alternatively, the laminate layers can adhere to one another through the use of heat, welding, or pressure. The type of laminate material used can depend on the application and method for laminating the layers, and types of laminate material are known. For example, laminate film can include the following materials: polyolefin, polypropylene, polyimide, polyvinyl chloride, acetate, polytetrafluoroethylene, polyethylene terephthalate, rubber material, cellulous material, or metallized film. Lamination techniques known in the art can be used to laminate the layers having the conductive or static dissipative microfibers and ground, as described herein. Once laminated, the laminated material achieves improved strength, stability, protection, appearance, and chemical resistance for use with static elimination methods. FIG. 3 shows examples of various laminate materials (e.g., clean food laminate 32 pharmaceutical laminate 34, heat resistant laminate 36, durable laminate 37, low-cost laminate or films 38, etc.) industrial uses that can be used for different applications with the PIL of the present invention. In an embodiment, the laminate layer or layers also includes one or more substrates of insulative or anti-static material into which or one which the conductive or static dissipative material or microfibers can be placed or printed, as further described herein. In an embodiment, such substrates include polymers, varnish, coating selected for its intended use and to protect the ionizing points and reduce capacitance for either passive or active ionization.

The conductive or static dissipative material or microfibers and ground are positioned between two layers during lamination. Accordingly, conductive or static dissipative material or microfibers 6 and ground 8 are sandwiched or encased by laminate layers 2 and 4. See FIGS. 1A, 1C and FIG. 2. The laminate layer has a protective surface and a lamination surface. The protective surface is the surface of the laminate piece that becomes the outer surface of the device after lamination, and the laminate surface of the laminate piece is the surface that is laminated to another laminate piece. In an embodiment, two or more laminate layers can be laminated can be laminated to one another, and between each or certain chosen layers the material/microfibers and ground can reside within. Such a construction, in an aspect, allows for multiple and layered ionizing edges of conductive points suspended in space for more effective ionization. Adhesive impregnated with electrically conductive or static dissipative material/microfibers is laminated between two protective laminate films or substrates.

The function of laminate with respect to the PIL of the present invention is to protect ionizing points 12 and the conductive or static dissipative material/microfibers 6 from damage when the PIL is in use. In particular, laminate layers 2 and 4 impart the protection of the fiber from damage and also prevents it from breaking off or trapping particulate matter. The use of a laminate in a static eliminating device is counter intuitive because a laminate layer is generally thought to increase the capacitance and thus reduce the voltage reaching the ionizing edge of conductive points. Based on this, one would conclude that laminating material on conductive material/microfiber at or near their end would make them ionize much less efficiently because of the increase in capacitance. However, the present invention includes a low profile edge or slit edge 10 in the laminate, as further described herein, that exposes the ionizing points. See FIGS. 1C and 1D. Surprisingly, the data in the Exemplification show very effective and efficient ionization of static charge from passing material. The data shows efficient ionization in experiments involving very fine solid fibers of stainless steel which were place on plastic tape about 0.25" apart along the edge. The edge was created and exposed the ionizing points and was cut with a razor to eliminate the fiber from extending into space. Despite this, ionization of the static charge occurred effectively.

Figure 1C:
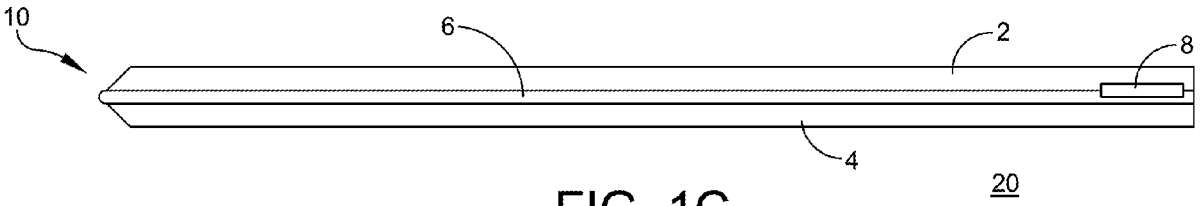
Figure 1D:
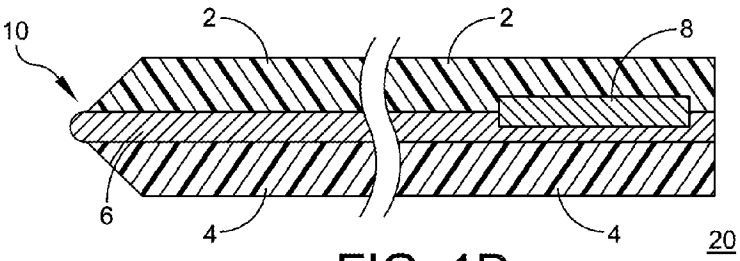
Figure 2:
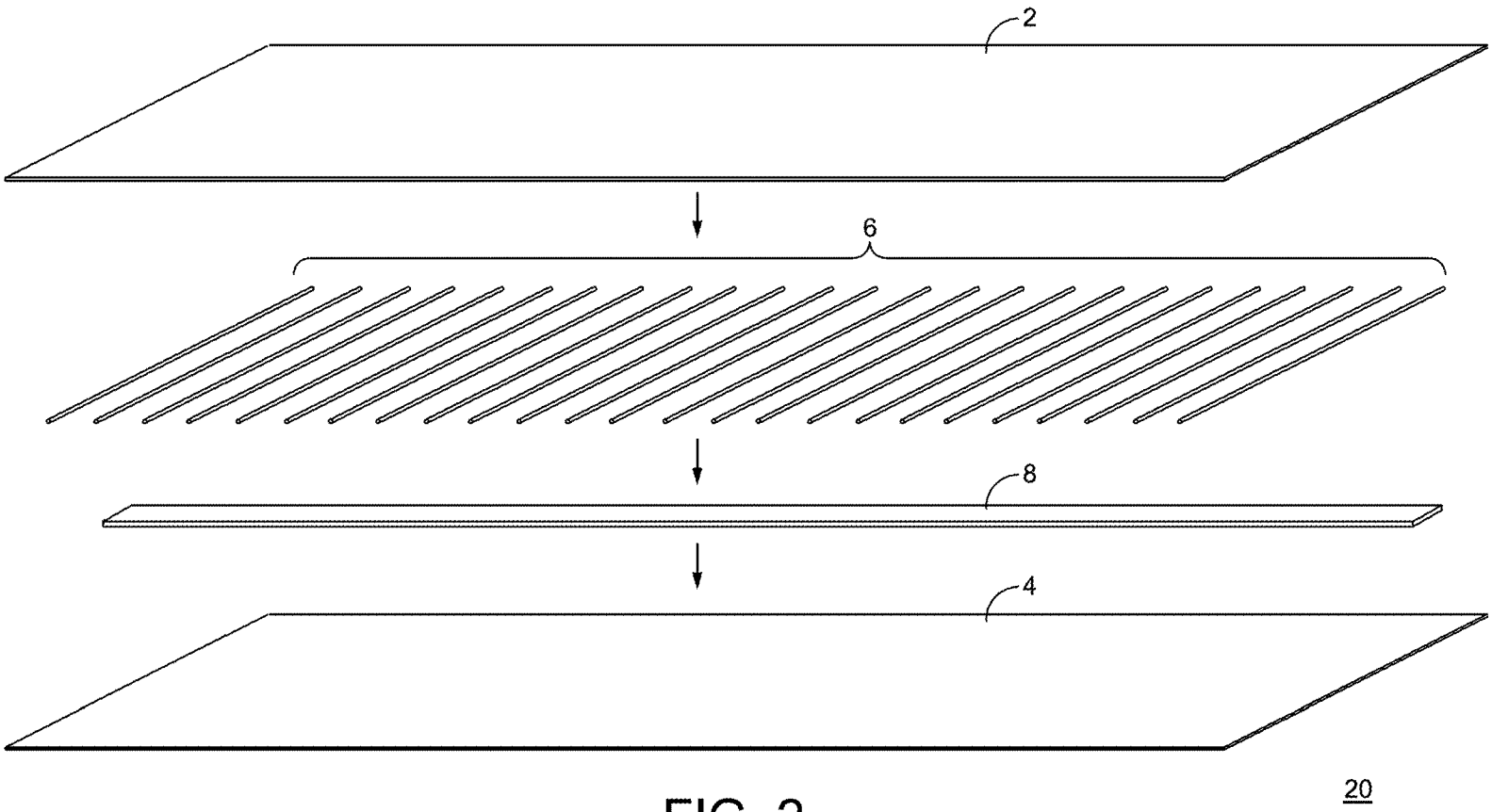
FIG. 2 is an exploded view of the separate parts found in the PIL of FIG. 1A.

The laminate layers also function as an encasement to hold in place at least a portion of the conductive or static dissipative material/microfibers and/or the ground. During the lamination process, the layers, when adhered to one another via adhesive, heat, pressure and the like, the fibers and/or ground are laminated between the layers. See FIG. 2 showing an exploded view of the PIL in FIG. 1. FIG. 2 shows laminate layers 2 and 4 encasing conductive or static dissipative material/microfibers 6 and/or ground 8 to create PIL 20. In the case of a single layer, during the lamination process, the layer is adhered to a machine/device on which the PIL is used, via adhesive, heat, pressure and the like, the fibers and/or ground are laminated between the laminate layer and the machine. The conductive or static dissipative material/microfibers and ground are sandwiched or positioned between the laminate layers (or between the laminate layer and the machine), so that they stay in place during use. Additionally, the use of a laminate as an encasement allows one to clean and/or sterilize the PIL static eliminating device. In an additional aspect of the invention, the laminate materials can be chosen that suit the particular application for which the ionization device will be used. For example, one can choose laminate material that can withstand various cleaning, washing, water, high heat, autoclave process and/or sterilization. This quality of the laminate material makes the PIL device of the present invention suitable for aseptic, medical and food contact packaging applications and others similar applications, as further described herein. For example, if the application requires exposure to high temperature, the PIL can be constructed of materials and adhesive with high temperature resistance.

The laminate is durable enough to protect the conductive or static dissipative material/microfibers from damage but also is thin enough to cut into place for any particular application. For example, once laminated, the PIL of the present invention can be cut into any shape to fit the machine or application. In particular, the laminate layer has a thickness ranging between about 5 μm to about 300 μm (e.g., about 10, 20, 30, 40, 50, 60, 70, 80, 90, 100, 120, 140, 160, 180, 200, 220, 240, 260, 280 μm). See FIG. 1D. The length of the PIL can be any length so long as it is suitable for the machine, apparatus or device in which it will be used. See FIG. 8F. Any type of laminate now known or later developed can be used with the present invention so long as it can encase the conductive or static dissipative material/microfibers and/or the ground. Types of laminate materials include, for example, synthetic or polyolefin film or tape, including thermoplastic polyolefins: polyethylene (PE), polypropylene (PP), polymethylpentene (PMP), polybutene-1 (PB-1); polyolefin elastomers (POE): polyisobutylene (PIB), ethylene propylene rubber (EPR), ethylene propylene diene monomer (M-class) rubber (EPDM rubber). Generally, many plastics can be formed into a thin film and include polyethylene (Low-density polyethylene, Medium-density polyethylene, High-density polyethylene, and Linear low-density polyethylene), polypropylene (e.g., a cast film, biaxially oriented film (BOPP), or as a uniaxially oriented film), Polyester (BoPET is a biaxially oriented polyester film), nylon, polyvinyl chloride (film can be with or without a plasticizer), and bioplastics and biodegradable plastics. Semiembossed film or tape can also be used to make the PIL of the present invention and semiembossed film can be used as a liner to the calendared rubber to retain the properties of rubber and also to prevent dust and other foreign matters from sticking to the rubber while calendaring and during storage. Other materials include para-aramid tape, Polytetrafluoroethylene (PTFE) material, polyvinyl chloride (PVC) material, non-stick slippery tape or high temperature tape. These materials are commercially available. For example, the non-stick slippery tape or high temperature tape can be purchased from 3M Company (Saint Paul, Minn., USA).

The protection of the laminate is from contamination, physical damage, breakage, washing, abrasion, solvent damage, high heat, cold, other environmental requirements, physical exposures, etc.

Figure 4:
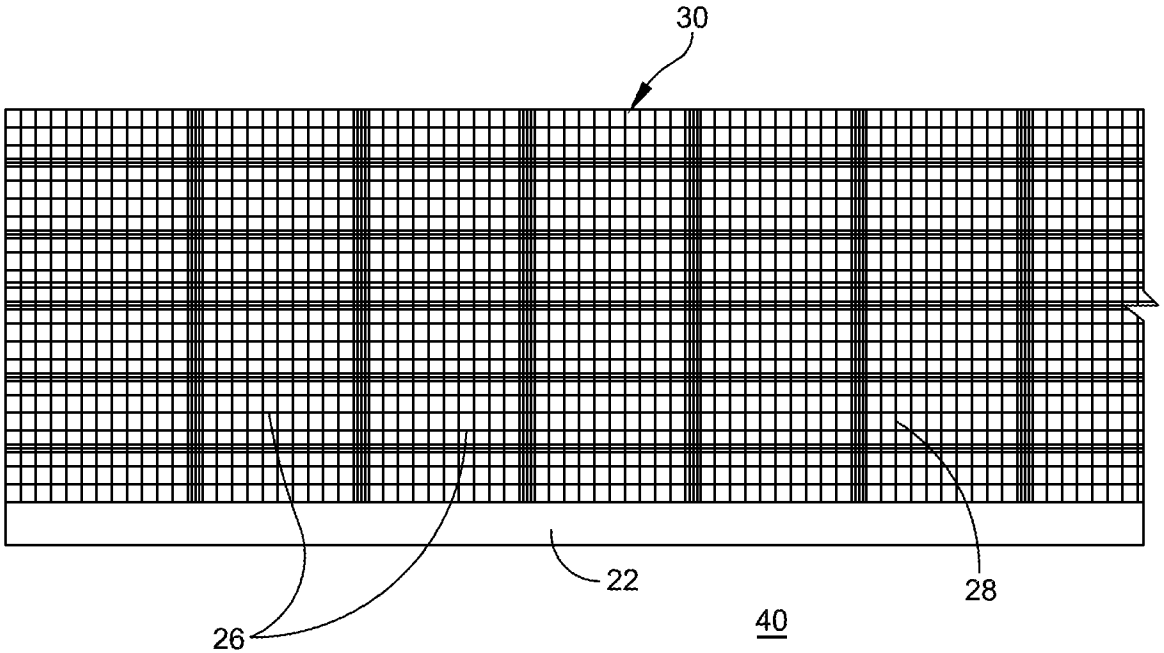
FIG. 4 is a schematic of a PIL of the present invention in which the material/microfibers are a mesh and the ground is interwoven into the mesh.
Figure 5:
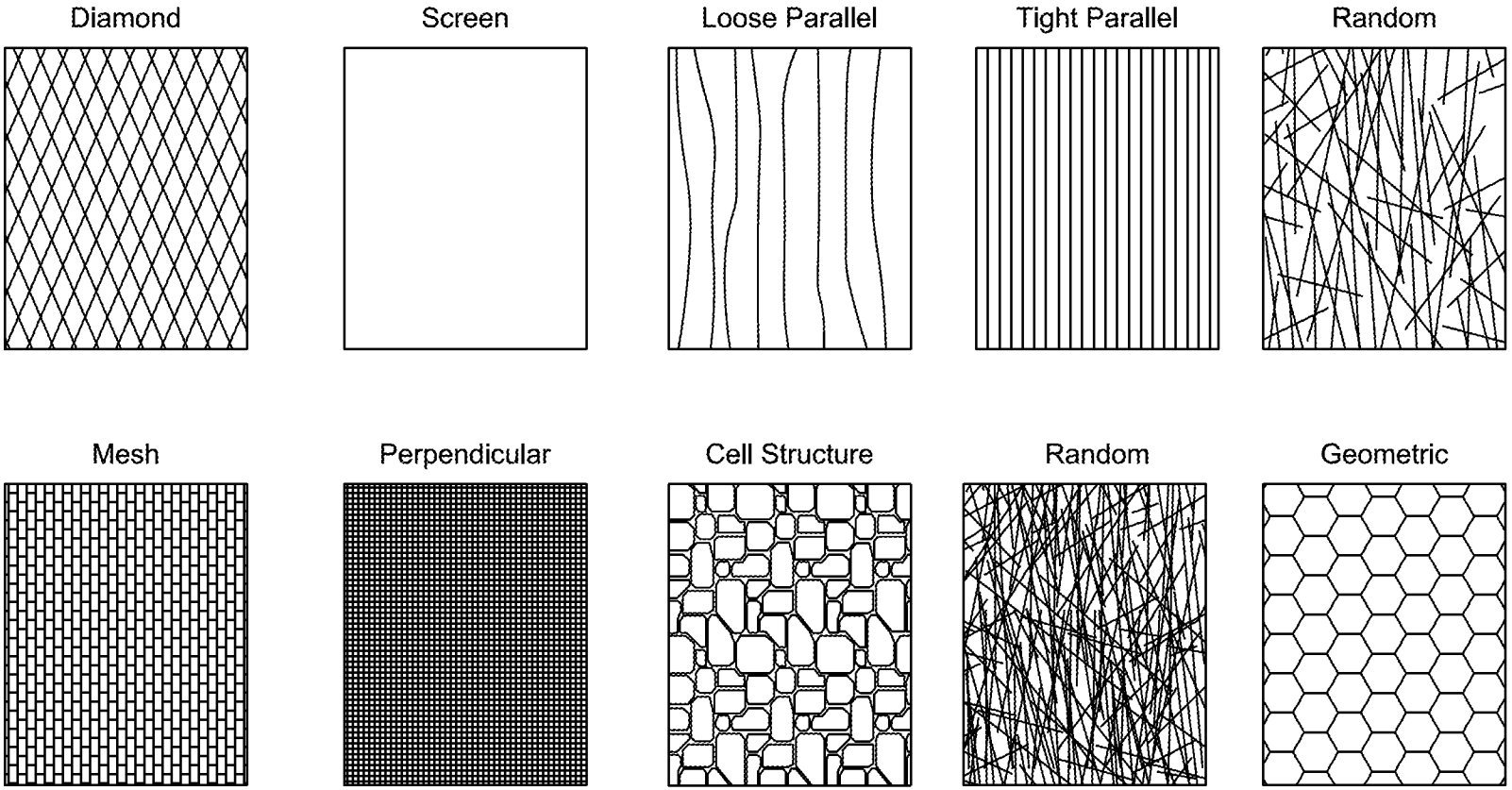
FIG. 5 shows several different types of electrically conductive or static dissipative material/microfibers arrays (e.g., diamond, screen, loose parallel, tight parallel, random, mesh, perpendicular, cell structure, random, geometric) that can be used for the PIL of the present invention.

Electrically Conductive or Static Dissipative Material/Microfibers:

As shown in FIGS. 1A-B, the present invention includes a plurality of electrically conductive or static dissipative materials/microfibers 6 that are disposed between laminate layers 2 and 4 in a pattern. In an embodiment, microfibers refer to a conductive or static dissipative fibrous material. In addition to microfibers, any type of conductive pathway can be used to establish a pattern of conductive/static dissipative material. Accordingly, the invention refers to "electrically conductive or static dissipative materials/microfibers" which refers to any material that can form a pattern of such material. The conductive or static dissipative materials/microfibers can form any type of pattern of material or fibers so long as when the ionizing points are in electrical communication with the ground, the pattern of points allow for the ionization of static electricity. FIG. 4, for example, shows a mesh pattern, and FIG. 5 shows a variety of patterns that can be used and include for example, diamond, screen loose parallel, tight parallel, random, mesh, perpendicular, cell structure, random, and geometric patterns. FIG. 4 shows PIL 40 with first laminate layer 28, a plurality of microfibers 26, ground 22 and a series of ionizing points at edge 30. In FIG. 1A, the pattern is generally a plurality of parallel wires connected by a ground that transects the wires. Any pattern can be formed so long as they are in electrical communication with at least one other microfiber or the ground, and can ionize a static charge.

Conductive refers to a surface resistivity of less than $1\times10^5$ Ω/sq. and static dissipative refers to a surface resistivity of between about $1\times10^5$ and about $1\times10^9$ Ω/sq. See Table 1. Accordingly, the material/microfibers form pathways from the ionizing points to the ground and has surface resistivity of less than about $10^9$ Ω/sq. As used herein, "conductive material" refers to the material between ionizing points and the ground and can include both conductive and static dissipative material/microfibers since both conductive and static dissipative material/microfibers allow for travel of the charge to ground.

TABLE 1

| Ohms Per Square | Material | Description |
|---|---|---|
| $>1\times10^{12}$ | Insulative | Develops and Holds surface static charge by contact/separation (tribo-electric generation) and cannot be grounded. The surface static charge must be lowered by passive or active ionization. |
| $10^9$ to $10^{12}$ | Anti-Static | Resists tribo-electric charging if treated or loaded with surface active antistatic chemicals that attract moisture. Not useful as a path to ground. Blocks the path to ground |
| $1\times10^5$ to $10^9$ | Dissipative | Slow surface static charge discharge to conductors and ground. |
| $<1\times10^5$ | Conductive | Provides path for charge to conduct to ground. |

Figure 7B:
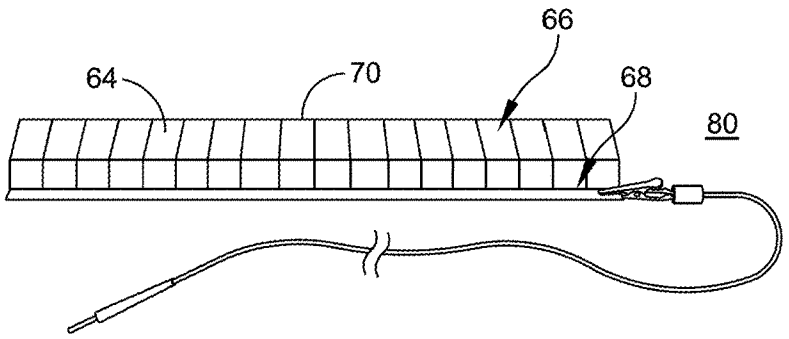
FIG. 7B is a schematic of a PIL using a flat profile linear bar as a ground and microfibers made from steel, both encased within the laminate layers. A ground wire is also shown.
Figure 7A:
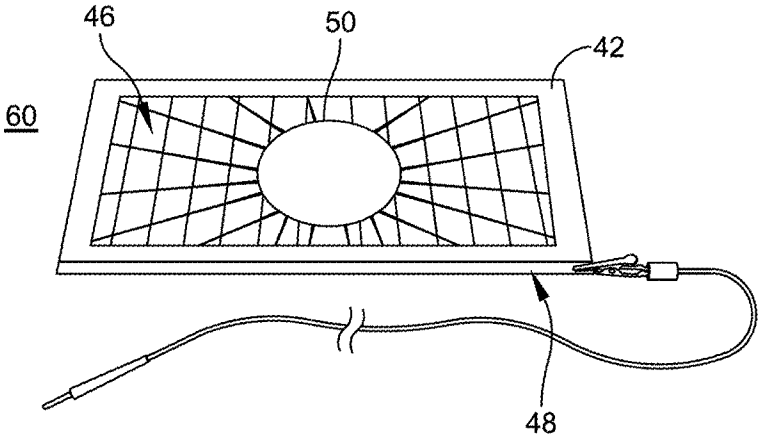
FIG. 7A is a schematic of three dimensionally printed PIL of the present invention in which the electrically conductive or static dissipative material form an irregular grid shape and the edge with the exposed ionizing points is formed in the inner circle shown.

An edge or slit is made or cut into the laminated layers having the conductive or static dissipative material or microfibers there between. FIG. 1C shows edge 10 exposing conductive or static dissipative material or microfiber 6. When the edge or slit 10 is cut into the laminate, the ionizing points 12 are formed at the cut point. The material/microfibers are encased and protected by the laminate except for the ionizing edge 10 of conductive points 12. In other words, when the conductive or static dissipative material/microfibers are placed on the lamination surface of a laminate layer and covered/laminated with another laminate layer, there are no exposed points across its flat outside protective surfaces. The conductive or static dissipative material/microfibers pathways are chosen, placed, printed on the laminate so that when the PIL is cut, trimmed, slit or die cut, there is a multiplicity of ionizing points along the exposed edges of the laminate. See FIG. 7A showing conductive or static dissipative material 46 exposed at edge 50 of three-dimensionally printed PIL 60. In PIL 60, substrate 42 encases the conductive or static dissipative material 46 long with ground 48. The ionizing points are created by precisely printing the conductive material onto the substrate, and this creates the static eliminating device. This configuration allows for the ionizing points to be exposed to the static charge while protecting the ionizing points and the conductive or static dissipative grounding pattern. The edge of ionizing points can be located at any place on the protective surface of the laminate layer. The location of the ionizing points (e.g., location of the edge) can be chosen depending on the use of the static eliminating device and location of the charged material passing by the device. For example, if the material that is passing by the static eliminating device passes by the device's edge when placed in a machine/apparatus, then the edge is a good place for the edge to expose the ionizing points. If the material is passing by the middle of the device, then the edge may be located in the middle of the device. Similarly, the PIL can be placed on the perimeter and/or wall of a passage through which insulative material passes. (e.g., like wallpaper lining a silo to prevent build-up of insulative material on the walls). Additionally, the one or more PIL devices can be stacked or arranged so as to eliminate static charge at different points in the processing of the material in the apparatus.

In considering the laminate layers and the ionizing edge of conductive points, one can increase the size, shape and conductivity of ionizing points and reduce the capacitance of the laminate when making the device. See FIG. 1C which is a drawing not to scale but illustrating how the edge is made to reduce capacitance which allows more voltage to reach the ionizing edge of conductive points. During the formation of the edge or slit, the laminate can be cut away or cut at an angle, as shown in FIG. 1C, to reduce the profile of the laminate layer. Additionally, the laminate layers have various profiles and a thicker profile can be used on one side to provide protection and a lower profile later can be used on the side on which the ionizing points will be exposed. The lower profile laminate layer will have a reduced capacitance when the edge/slit is formed so that more voltage can reach the ionizing edge of conductive points. On the other hand, additional conductive or static dissipative material can be placed at the edge to further reduce capacitance and increase voltage reaching the ionizing edge of conductive points. The pattern of the conductive/static dissipative material can be such that more ionizing points reside at the sedge. For example, conductive ink can be used to "print" conductive material at the edge for more efficient ionization, or a pattern of fibers can be made so that it is more concentrated at the edge/slit. For example, using Computer Aided Design (CAD) technology, the size, shape and configuration of the ionizing points can be varied with the size shape and thickness of the laminate layers to reduce capacitance and increase the voltage reaching the ionizing edge of conductive points. The profile, shape, thickness etc. of the PIL materials on the cut edges can be configured so that more voltage reaches the ionizing edge of conductive points. By reducing the profile of the cut edge facing the charged materials, more voltage reaches the ionizing edge of conductive points. Also, by allowing the point ends to be slightly closer to the charged field by cutting the upper and lower protective layers in a way that the capacitance of the protective layers is less (e.g., at an angle). See FIG. 1C. In another embodiment to achieve this, a thicker first laminate layer is chosen for its protective characteristics and is coated with adhesive for lamination, then the ionizing means is attached to the adhesive of the first layer. A low profile second laminate layer is chosen to covers the conductive material. When the laminate encasing is cut at an angle the capacitance of the PIL at the ionization points are reduce due to a combination of a first laminate layer being cut away and a second layer having a low profile. This allows the ionizing points to be closer to the charged materials so that more voltage reaches the ionizing edge of conductive points. In the example shown in FIG. 1A-D, the profile of the ionizing wire was about 35 μm, and the profile of each laminating layer is about 48 μm, so that the profile of the entire PIL is about 133 μm.

The capacitance of the laminate layers can be reduced at the ionization points in other ways, such as floating the ion points on or in the adhesive layer and reducing protective layer thickness at or near the points. Also, the conductive material can be chosen, configured or printed, and the size and shape of the lines can be varied (e.g., pattern be made thicker, wider, shaped, etc.) on one or both of the protective layers so that when the PIL is cut, the ionizing points can be the size and shape to reduce the capacitance and allow more voltage to reach the ionizing edge of conductive points.

Also, in another aspect, the type of edge created by the cutter or printer can increase the ionization to points. For example, a cutter that creates a rough edge on the conductive points will enhance ionization to those points. Variations in the type of slit/edge can be made to cut away the protective layer and increase exposure of the ionizing points. In another aspect the points can be placed on a surface and using 3D printing they can be raised up vertically above the surface. The protective layer can be molten plastic or various coatings to encase the PIL. The point points can be covered so they are exposed or they can be exposed by removing just the portion of protective surface covering the point points.

When utilizing CAD to design a series of ionizing points in a pattern on a suitable substrate, then the substrate can be die cut to have a slit of points at the edge of the PIL to efficiently ionize charge from charged objects passing near them and a series of efficient conductive pathways to carry the ionized charge to ground. Choosing from a variety of conductive inks to print such series of points and pathways and materials makes custom manufacture of the static eliminators simple, inexpensive and very consistent. This allows for the PIL of the present invention to be designed to fit exactly where it is needed on the machine, and printed and cut on a plotter as needed by the user on a substrate so it has a ground contact to the metal of the machine and can be mounted in place easily with adhesive or mechanically.

An application of the PIL of the present invention includes its use in small spaces or applications involving voltage suppression. An example of such an application is the PIL's use with "pick and place" machines which use mandrels for transporting cups from forming or molding. There is a geometric relationship between the points and the charged surface. So the size and spacing of the points affects the amount of voltage reaching the points. With the PIL of the present invention, the size of the points can be much smaller and can be placed on machines/devices where there is little space and the charged objects will be very close to the points. New conductive material such as Graphene which is 200 times more conductive than copper can be used making these smaller points.

In an embodiment, the diameter of the ionizing points ranges between about 100 nm to 50 μm (e.g., 150 nm, 200 nm, 250 nm, 300 nm, 350 nm, 400 nm, 450 nm, 500 nm, 550 nm, 600 nm, 650 nm, 700 nm, 750 nm, 800 nm, 850 nm, 900 nm, 950 nm, 1 μm, 5 μm, 10 μm, 15 μm, 20 μm, 25 μm, 30 μm, 35 μm, 40 μm, 45 μm) depending on the size and geometry of the placement, and in an embodiment about 5 μm and about 10 μm in diameter. The small cross-sectional area at each exposed fiber end/point, fold, or sharp bend provides the required "ionizing points" to induce ionization. That is, the voltage pressure or potential at each ionizing point is increased, inducing ionization of the air between the passing statically charged material and the ionizing points. The conductive ionizing points ionize the charge and the conductive or static dissipative materials provide a path to ground for the charge. The electrically conductive or static dissipative materials can be any form that allows for a grounding pattern. Examples of the grounding materials are microfibers, wires, threads, yarns, lines, non-woven material, woven material, braided, printed conductive lines or any combination thereof. In another aspect, the pattern or configuration can be printed, jetted, non-woven or have a specific placement, and the pattern can be preset or random. The pattern should be configured such that when the exposed ionizing points ionize static charge between them and charged material placed or moving near them, the discharge current flows to ground via a ground wire or to a conductive part of the apparatus/machine.

The type of material, from which the conductive or static dissipative materials can be made, include any conductive material, such as, conductive metals, conductive plastics, conductive polymers and static dissipative material, include metal, carbon, metal coated carbon, copper, silver, gold, stainless, tungsten, steel, graphene, metal coated acrylic, metallized acrylic, conductive polymers including, inks—(e.g., screen printed inks or 3D printing inks) and jetted conductive materials, composite materials, static dissipative polymers or a combination thereof. The entire pattern can be fabricated from the conductive material or static dissipative material. Further, non-conductive microfibers can be formed into a pattern and metallized, coated, or otherwise treated, after the pattern-formation process, and braided. In a certain aspect, the microfibers can be "printed" on a laminate material with conductive ink (e.g., Graphene ink). In such an example, any printed pattern can be used to create the controlled pattern of microfibers. Accordingly, the term "microfibers" include any material that can provide for a controlled conductive pattern, and allows for the ionization of the static charge in the PIL described herein and includes materials such as conductive ink although they may not be made of "fibers". Also, when the conductive inks are used to print the conductive material, the ionizing points can be printed at the edge/slit of the laminate.

With respect to "printing" conductive or static dissipative microfibers, digital printing and/or 3D printing which can use a variety of conductive and static dissipative inks, liquefied materials including metals and nanoparticles which lay down the pattern of conductive or static dissipative lines which carry the discharge current from the points. Printing methods allow not only precise laydown of materials but also the choice of conductivity, thickness and shape of materials suitable for the function when cut into a suitable shapes so that when the laminate is cut on a digitally controlled plotter to form the static eliminating device, the exposed points are the material of choice for size, shape and conductivity to reduce capacitance and ionize effectively and the ground pattern functions to carry the discharge current where it connects to ground.

In one aspect of the invention conductive or static dissipative fibers are chosen for their ability to reduce charge on charged objects and surfaces by ionization to their points. The fibers are laminated between protective thin film materials. When the lamination is die cut to suit the application the small encapsulated fiber points are exposed only along the edges between the laminate layers so that when the laminate is placed in a static charge field, ionization occurs at the points and the charge travels between the laminate layers to ground.

In another aspect of the invention the conductive points are provided by using a veil of conductive materials which is laminated between the protective films. Also a suitable conductive foil can be used. Further various conductive foils or conductive inks are wires can be used as the grounding means on or within the protective laminate.

The present PIL inventions can be used in place of tinsel static eliminators. The static tinsel eliminators have problems such as brittleness, sloughing of slivers, oxidation of copper at its exposed edges, sharpness of the metal edge, etc. Rather, the PIL of the present invention is durable, has encased conductive materials to avoid sloughing or sharp metal edges. The PIL of the present invention is able to avoid these problems while providing an ionizing edge of conductive points.

Figure 6:
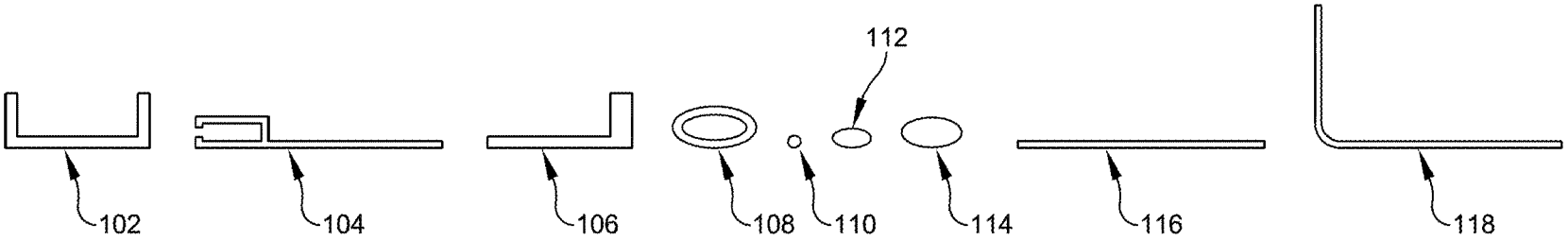
FIG. 6 is a schematic of various different grounds that can be used in the PIL of the present invention. Such grounds can also be used as mounts.

The Ground:

A ground refers to the removal the excess charge on material passing the PIL by means of the transfer of electrons away from the passing material. Ground 8 in FIGS. 1A, 1B, 1C, 1D, and 2 and ground 58 in FIG. 7B are shown as a flat conductive strip, whereas ground 48 is shown in FIGS. 7A and 7B as a wire. Specifically, FIG. 7A shows PIL 60 having insulative substrate 42, conductive or static dissipative ink 46, ground 48 and ionizing points at edge 50; and FIG. 7B shows PIL 80 having laminate layer 64, microfibers 66, ground 68 and ionizing points at edge 70. The ground, in certain embodiments, will include the conductive pattern itself. This is so because when the ionizing points are created (e.g., when the laminate layer is cut/slit), the rest of the conductive material will allow the discharge current to travel from the ionizing points to the ground. The ground is any object that can remove the excess charge. The ground can be made from the conductive or static dissipative materials and the pattern described herein can also in certain embodiments act as a ground. The ground can be a metallized surface, wire, a conductive material, static dissipative material, or conductive foil, in electrical communication with the conductive material. The ground can be in any form that allows the charge to be removed, such as a conductive strip, a conductive bar, conductive wire, or a conductive rod. The ground can also act as a mount and can be shaped so that the PIL is received by the machine or apparatus. The ground of PIL of the present invention can be adapted to be mounted to the machine/apparatus of intended use. FIG. 6, for example, shows a number of different types of mounts/grounds. The mounting options include flexible or rigid and can be any shape including circular grounds (e.g., grounds 108, 110, 112, 114), flat (e.g., ground 116), angled (e.g., ground 102, 106 and 118) curved or irregularly shaped (e.g., ground 104). As material carrying the charge passes the PIL, the charge ionizes from the material at the ionizing points. The static charge travels through the conductive material to the ground and is removed from the system.

Figure 8C:
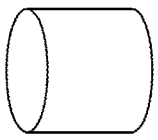
FIG. 8A-E shows graphical illustrations of various forms of the PIL and/or laminate of the PIL. For example.
Figure 8B:
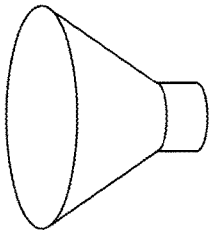
Figure 8A:
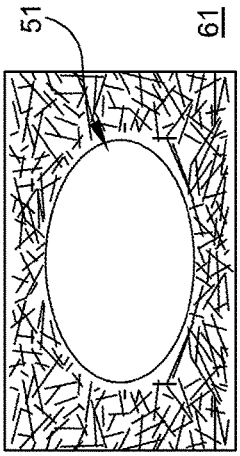
Figure 8D:
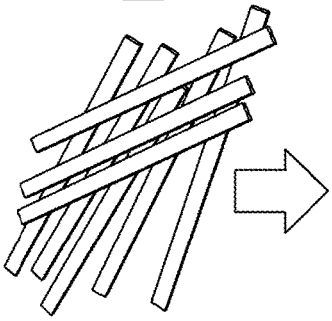
Figure 8E:
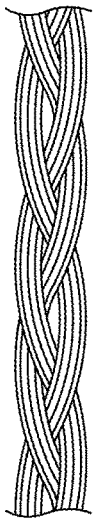
Figure 8F:
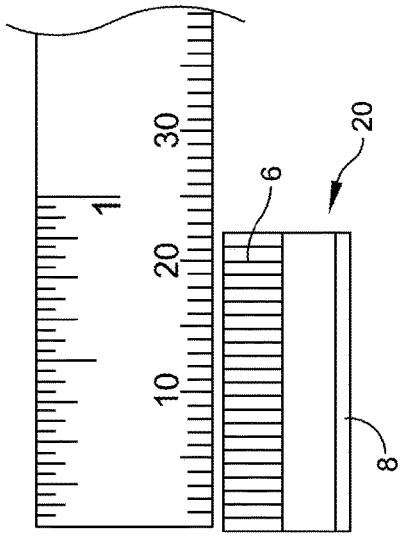
FIG. 8F is a schematic showing the actual size of a PIL being as small as 20 mm in length.

Once the device is configured, it can be cut or shaped to fit into the machine or apparatus that needs static charge removal. The PIL can be cut into squares, rectangles, polygons, narrow strips, narrow threads, or any irregular shape. The PIL also can be die-cut into any desired shape. See FIG. 8A. PIL 61 of FIG. 8A shows edge 51 of ionizing points wherein the edge is shaped into an oval. The PIL of the present invention can formed into a conical shape or a cylindrical shape as shown in FIGS. 8B and 8C, or any three dimensional shape (e.g., spherical, cubical, pyramidal, and any type of prism). Strips (FIG. 8D) can then be gathered, braided (FIG. 8E), sewn, in the manner common to many machines. Additionally, pieces of the laminate or the PIL itself can be perforated for separation and/or ease of use. The PIL of the present invention has, in an embodiment, a profile ranging between about 5 μm to about 500 μm (e.g., between about 50 μm and about 250 μm, and between about 100 μm and 150 μm) (e.g., having a profile of about 10, 20, 30, 40, 50, 60, 70, 80, 90, 100, 120, 140, 160, 180, 200, 220, 240, 260, 280, 300, 320, 340, 360, 380, 400, 420, 440, 460, 480 μm).

Static Electricity:

Static electricity is defined herein as surface storage of electric charge. This surface charge is caused by induction or by the transfer of electrons when two similar or dissimilar surfaces contact and/or separate. The charge also creates a voltage field which attracts or repels other objects which are proximate to the field.

When a statically charged object (e.g., a piece of tape) is suspended in air, and not near another object, the voltage field will induce out in all directions. Conventional ionizer both passive and active can ionize this inducing voltage.

However, when a charged object is in contact with or in close proximity to another object or surface, the field is disturbed and the electrons are induced toward the object or surface. For example, when a piece of statically charged thin film is laid on a flat surface, the film's surface static field is inducing between the two surfaces, "clinging" to each other, and there is no voltage inducing out from the exposed top surface. When the voltage is attracting in one direction, the voltage is suppressed from the other directions and is not inducing from the exposed side. Hence, the top side of the charged thin film or sheet has no voltage induction, so static eliminators or ionizers cannot neutralize the charge. In converting machines, rollers or flat surfaces are close in proximity to the sheet or film and this results in a higher capacitance. On printing machines, sheets on a stack are in close proximity to each other. This means there is higher capacitance and voltage suppression because the voltage is trapped between the layers.

Capacitance reduces the voltage by the induction and conventional air ionizing devices, both active and passive cannot remove the charge. Some refer to this as voltage suppression because there is little voltage on the exposed upper side of the sheet. A static field meter reads near zero levels.

Capacitance can be described as charge storage, which is also $C=Q/V$, and is illustrated by parallel plate arrangement. From the equation $C=Q/V$, the units are in coulomb/volt, which is equal to the Farad. C represents the capacitance of a statically charged material, Q is the magnitude of charge stored on each plate, and V is the voltage applied to the plates. Two parallel plates are the most common capacitor. When the plates are largest and closest together, the greatest capacitance occurs. Capacitance can be increased by inserting a dielectric material between the two plates.

In certain applications, when the dielectric material gets close to or contacts the surfaces of the machine, its surface static charge induces toward the surface and increases the capacitance and this reduces the voltage available to be ionized.

Additionally, an insulative material in motion can contact another surface causing triboelectric generation of static charge and the resulting cling without ever separating from the surface. Static generation is most commonly observed when similar and dissimilar materials contact and separate. However, the static generation occurs as soon as one material touches the other. As the molecules of one material closely approach those of another material, there is a transfer of electrons, generating a static charge. Whenever there is high capacitance and insufficient voltage pressure to induce or actively ionize, contact between objects will generate static charge and the resultant static problems, i.e., cling, drag, misalignment, electrostatic discharge (ESD), etc.

The static field inducing out from the charged surface is concentrated at the points and ionization of the surface charge in space begins at about 2 KV to about 5 KV. The efficiency of the ionization depends on several variables, taken into account in the PIL of the present invention. They include, for example, the size or sharpness of the points, the conductivity of the points, the point placement in the voltage field across the charged surface, the distance from the surface charge, and the charged material's proximity to objects near it such as machine parts and surfaces which attract the field as free space maximizes the induced voltage to the points.

Active and Passive Ionization:

The present invention includes the ability to produce both passive and active ionization.

In general, active or powered static eliminators have High Voltage (HV) side effects including attracting particulate and FM (foreign material) contamination, breakdown of their point surface material and the production of electrochemical contamination. They produce electro-chemical effects near their ionization points and the points deteriorate and lose material, etc. The FM contamination reduces the ability of their points to ionize. They also have problems with being suitably washed, cleaned, sterilized and maintained for their intended use in the application.

The PIL of the present invention can also be used as an active ionizing device by charging the edge of ionizing points with a conventional pulse DC generator or AC generator and providing a ground surface to enhance the production of ion current in the air near the points.

This provides improvements like those obtained by the passive PIL device and also reduces the problems common to powered devices including the feature of being able to clean the PIL by choosing a suitable protective laminate that can be washed and cleaned often. In one aspect of the PIL the protected points of the PIL can be cleaned automatically with a suitable washing, wiping, scraping, brushing, blowing chosen for the application. For example, a soft cloth treated with solvent, soap, detergent wipes across the edge of the PIL periodically to remove ink or coating that has splashed onto it or is fogging into the air near the coating or printing heads.

Since the ionization points of most powered static bars create HV side effects including electro-chemicals, particle attraction, FM production, breakdown of metal, etc., covering them with a protective laminate material chosen to resist the electro-chemical effects and chemical contamination and providing an easily cleaned protective laminate surfaces instead of the stem, the base of the electrode and surfaces nearby which hide and hold FM and chemical contamination. The PIL of the present invention can be powered to pulse ions or used with air assist to blow ions as part of a cleaning or to neutralize objects from a distance.

The ionizing point end of the PIL is selected to minimize deterioration by using the finest select materials and suitable composites. Also, most of the contamination will be collected on the protective laminate selected for the intended use and ease of cleaning.

Also the powered PIL can be used in conjunction with the passive PIL so that only a small amount of ions of a single polarity are needed to be actively generated to extend the range of the combination of the two PILs for neutralization with few HV side effects.

Using passive ionization with active ionizers, with respect to the PIL of the present invention, allows for monitoring the discharge current of the passive PIL and analyzing the amount of discharge current using a computer and adjusting the generation of a single polarity ionization with the powered PIL to extend the range and minimize the HV side effects.

Applications:

There are many applications including use in machines or apparatus that are used in food preparation, open food filling and packaging, pharmaceutical, medical, surgical, dental and clean manufacturing and packaging. Also, the PIL of the present invention can be used in machines that require explosion proof, high heat or cold resistance and can withstand cleaning, washing, and sterilization procedures to conform to the requirements and maintenance of an area.

In the case in which the application of the PIL is for placement on a machine and being part of the machine are numerous. The PIL as active ionizing points can be innovative in terms of making them disposable or reusable. In one aspect the active PIL is monitored for performance and as the contamination from the high voltage side effects reduce the ionization performance, the PIL are advanced like a thin tape exposing new PIL and performance. The used PIL is automatically and would up for cleaning and reuse or to be disposed.

For example, surgical packaging may require removing synthetics materials from sterilized plastic packaging and placing them inside a patient. If there is static charge on the synthetic material as it is separated from the package, airborne particles including bacteria will be attracted to it. The PIL of the present invention can be used in such a package adapted to receive the PIL and during removal of the sterilized synthetic material from the packaging; the static charge is dissipated as the synthetic material passes by the PIL. The removal of the static charge will reduce the attraction of airborne particles to the synthetic material and make it safer to move through space and implant into the patient.

The laminate layers can have pattern of conductive or static dissipative materials or points which minimize the triboelectric generation of static when one protective layer is separated from another as for example the PIL being used as a protective packaging which encases a membrane, plastic part or other non-conductive, chargeable material, which when one protective layer is separated exposing the part or material, prevents it from getting damaged from electrostatic discharge or from holding a charge on its surface which can attract particulate, FM (Foreign Material) including bacteria and other airborne contaminants.

Also, since the ionizing points are the very end of the conductive material and the entire pattern of conductors is for grounding, end points to ionize charge can be not limited to outer edges only as other protective points may be useful across the inside of the lamination to prevent or remove charging and/or electro-static discharge as materials are separated for use.

Another application or example is wallpaper that ionizes between itself and charged material. A release liner is removed from an adhesive side of the PIL which sticks it to the wall. The conductive pattern and points are between the adhesive side and the outside laminate. The outside laminate protects and provides a low coefficient of friction. The protective, anti-stick laminate can also be die-cut so it exposes the ionizing points in a pattern that is protected from contact and abrasion from charged objects coming near them and there is ionization between them and static charge is reduced on the objects so they will not cling to the surface. There are many variations on this and to increase ionization may require more exposure of ionizing points and while they are still protected from abrasion and physical damage they may potentially trap particulate more than an edge cut would allow.

As points and protective laminates vary in size, various geometries of the points in relation to the charged materials can be used.

Kits.

The present invention includes PIL static eliminating kits for use with a machine or apparatus. The PIL kit can include the various parts described herein. For example, laminate layers can be provided. In the case of a laminate layer that uses adhesive for the lamination process, release paper can be provided and the parts (i.e., the conductive material, and ground) can be put together as described herein. A perforation or removable strip or edge can be provided to make the edge or slit. Alternatively, a kit can come assembled with release paper on the exposed part of the conductive material that is to be connected to a ground (e.g., a metal surface) is covered with a release liner. In particular, such a kit includes:

The first laminate layer has an adhesive coating;

A pattern of conductive materials is placed on the adhesive;

An optional second laminate layer covers the fibers and is held by the remaining exposed adhesive of the first layer;

Part of the conductive fibers are left exposed on the first protective laminate and covered with a release liner; and The release liner is removed and the PIL is placed on metal which grounds the exposed conductive pattern.

Also, in an embodiment, on the top laminate can have an openings and slits across its flat exposed surface exposing conductive point ends so when it is folded over a part of the machine or surface for removing static the points are protected and remove static on nearby charges objects. A release liner can also expose point ends when removed from slits or openings in the protective laminate surface so when placed on a machine or surface for removal of static, the points are exposed and air between them and charged objects is ionized. Also a PIL was tested and has a protective upper or exposed layer with openings across its surface which exposes end points. The laminate protects the end points from contact from objects sliding across the PIL surface when on a machine or surface to remove static.

Alternatively, a conductive strip is placed over part of the conductive pattern before lamination is completed.

Exemplification

Testing of the Ionizing Laminate

Most engineers get frustrated with measuring static charge on plastics because they expect highly accurate and consistent results. They are familiar with measuring electricity on conductive wires which goes immediately to zero when grounded. Surface static electricity as found on plastics is highly irregular and cannot be grounded. In order to remove it from a surface, the surface must be in space so the voltage is not attracting toward an object or surface.

The Scotch Tape Static Charge Demonstration (STSCD) is consistent and realistic and can show all of these behaviors of surface charge easily and consistently. It has been used to teach many thousands of engineers how static electricity behaves on insulative materials

STSCD:

1. Rapidly unwind ¾" Scotch tape about 18-24"
2. Hold it out in space and demonstrate how it clings to your hand from both sides
3. Use a static field meter to measure the surface voltage along its length. It is useful because the tape is consistent in the surface charge generated between 10 kV and 15 kV.
4. Now we pass the sample of the static eliminator within 1" the tape from top to bottom.
5. Check it for "static cling" by passing my flat palm near the surface. If the tape clings, the sample is deemed to be >5 kV and fails.
6. Check the surface using the static field meter holding it 1" from the surface along its length.

TABLE 2-continued

| Common static problems | Surface charge to cause the problem |
|---|---|
| Static Shocks | >10,000 Volts |
| Surface Damage to coatings | >10,000 Volts |
| Printing and coating defects | >10,000 Volts |

One can see how the test results relate to the converting operation, at 3 kV there are zero defects.

In the following testing, all the samples were 3 kV (pass plus) or they were rejected.

Our testing of the samples reported all the samples were <3 kV (pass plus) or they were rejected.

The table, Table 3, below shows test results from testing 3 different PIL devices with the laminate described in the table, and comparing the PIL with a known static eliminator, the ion rod. The PIL devices effectively ionize static charge as well as the ion rod.

TABLE 3

| | 3 Test Products with Different Films | | | |
|---|---|---|---|---|
| Tape Demo<br>X < +10 KV<br>Record Results<br>X < 10 KV = Fail | Green Film PIL<br>Polyester<br>Thinkness = 2.5 mil (0.06 mm)<br>Caustic Environments | White Film PIL Biaxially<br>Oriented Polypropylene<br>Thinkness = 1.9 Mil (0.048 mm) | Clear Film PIL<br>Polypropylene<br>Thinkness = 3.1 Mil (0.07874) | Benchmark<br>Ion 360 Rod<br>Polyester and Stainless Steel<br>Test = Benchmark |
| +10 KV | 2.5 | 0.4 | 0.5 | 1.8 |
| +10 KV | 0.9 | 0.6 | 0.5 | 1 |
| +10 KV | 1.3 | 1 | 1.2 | 2 |
| +10 KV | 0.8 | 0.6 | 0.8 | 0.5 |
| +10 KV | 0.8 | 0.6 | 0.7 | 0.6 |
| +10 KV | 1 | 0.6 | 2.2 | 0.6 |
| +10 KV | 2.4 | 0.5 | 0.5 | 0.6 |
| +10 KV | 0.8 | 0.5 | 0.6 | 0.7 |
| +10 KV | 0.7 | 0.4 | 0.6 | 0.6 |
| +10 KV | 1.8 | 0.5 | 0.4 | 1.9 |
| +10 KV | 0.6 | 0.5 | 0.6 | 1 |
| +10 KV | 1.5 | 0.5 | 0.6 | 1.6 |
| | Option#1 | Option#2 | Option#3 | Test Device |

Results:

>5 kV—Fail

<3 kV—Good

<2 kV—Excellent

Here are the levels of surface charge generated by converting operations

| Operation | Common surface charge levels |
|---|---|
| Plastic Extrusion | 10-20 kV |
| Slitting & winding | 15-25 kV |
| Corona treating | 20-30 kV |
| Printing | 10-20 kV |
| Bag Making | 10-25 kV |
| Thermoforming | 15-25 kV |
| Plastic Molding | 15-25 kV |
| Gravure and Flexo Printing | 20-30 kV |

Following is a list of common static problems and the surface charge where the problems begin to occur.

TABLE 2

| Common static problems | Surface charge to cause the problem |
|---|---|
| Zero Defects | Less than 3000 volts |
| Microscopic Dust Attraction | >3,000 Volts |
| Common Dust attraction | >5,000 Volts |
| Ignition of Vapor | >5,000 Volts* |
| Static Cling | >7,000 Volts |

The terms about, approximately, substantially, and their equivalents may be understood to include their ordinary or customary meaning. In addition, if not defined throughout the specification for the specific usage, these terms can be generally understood to represent values about but not equal to a specified value. For example, 1%, 0.9%, 0.8%, 0.7%, 0.6%, 0.5%, 0.4%, 0.3%, 0.2%, 0.1%, 0.09% of a specified value.

The terms, comprise, include, and/or plural forms of each are open ended and include the listed items and can include additional items that are not listed. The phrase "And/or" is open ended and includes one or more of the listed items and combinations of the listed items.

The relevant teachings of all the references, patents and/or patent applications cited herein are incorporated herein by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A protective ionizing laminate (PIL) static eliminating device that comprises:

a) at least two laminate layers comprising a first laminate layer and a second laminate layer, wherein the first laminate layer, the second laminate layer, or both has a thickness ranging between about 5 μm to about 300 μm;

b) a plurality of electrically conductive or static dissipative material or microfibers, wherein the plurality of electrically conductive or static dissipative material or microfibers forms a pattern;

c) a ground in communication with the electrically conductive or static dissipative material or microfibers;

wherein the at least two laminate layers are laminated together with the electrically conductive or static dissipative material or microfibers and at least a portion of the ground positioned there between, to thereby form a laminated enclosure; and d) an edge cut into the laminated enclosure exposing the plurality of electrically conductive or static dissipative material or microfibers to create an edge of ionizing points, to thereby obtain a PIL static eliminating device, wherein the plurality of electrically conductive or static dissipative material or microfibers is encased by the two laminate layers except for the edge of ionizing points, wherein the diameter of the ionizing points ranges from between about 100 nm to 50 μm;

wherein air between the ionizing points and charged material passing by or near the PIL static eliminating device is sufficiently ionized to remove or reduce static charge from the passing material.

2. The PIL static eliminating device of claim 1, wherein the at least two layers are laminated to one another by heat, pressure, welding, or adhesives.

3. The PIL static eliminating device of claim 2, wherein the electrically conductive or static dissipative material or microfibers are made from metal, carbon, metal coated carbon, copper, silver, gold, stainless steel, tungsten, steel, graphene, metal coated acrylic, metallized acrylic, conductive polymers, inks and jetted conductive materials, composite materials, static dissipative polymers or a combination thereof.

4. The PIL static eliminating device of claim 1, wherein the plurality of electrically conductive or static dissipative material or microfibers is selected from the group consisting of wires, threads, yards, and printed conductive lines.

5. The PIL static eliminating device of claim 4, wherein the electrically conductive or static dissipative material or microfibers have a diameter between about 100 nm to 50 μm.

6. The PIL static eliminating device of claim 1, wherein the at least a portion of the ground comprises metalized protective material, a conductive material, or static dissipative protective material.

7. The PIL static eliminating device of claim 1, wherein the ground comprises a conductive strip, a conductive bar, conductive wire, conductive foil, or a conductive rod.

8. The PIL static eliminating device of claim 1 having a profile ranging between about 5 μm to about 500 μm.

9. The PIL static eliminating device of claim 1, wherein the static eliminating device is cut or dye-cut into a desired shape.

10. The PIL static eliminating device of claim 1, wherein the at least two laminate layers are made from polyester film, para-aramid tape, polyolefin, polypropylene, polyimide, polyvinyl chloride, acetate, polytetrafluoroethylene, polyethylene terephthalate, rubber material, cellulous material, or metalized film.

11. A PIL static eliminating device that comprises:

a) a first laminate layer having a first protective surface and a first lamination surface, wherein the first laminate layer has a thickness ranging between about 5 μm to about 300 μm;

b) a plurality of electrically conductive or static dissipative material or microfibers attached to the first lamination surface of the first laminate layer, wherein the plurality of electrically conductive or static dissipative material or microfibers forms a pattern;

c) a ground in communication with the electrically conductive or static dissipative material or microfibers;

d) a second laminate layer having a second protective surface and a second lamination surface; wherein the second laminate layer has a thickness ranging between about 5 μm to about 300 μm and wherein the first lamination surface and the second lamination surface are laminated to one another with the electrically conductive or static dissipative material or microfibers and at least a portion of the ground positioned there between to thereby form a laminated enclosure;

e) an edge cut into the laminated enclosure exposing the plurality of electrically conductive or static dissipative material or microfibers to create an edge of ionizing points to thereby obtain a protective ionizing laminate static eliminating device, wherein the plurality of electrically conductive or static dissipative material or microfibers is encased by the first laminate layer and the second laminate layer except for the edge of ionizing points, wherein the diameter of the ionizing points ranges from between about 100 nm to 50 μm;

wherein air between the ionizing points and charged material passing by or near the protective ionizing laminate static eliminating device is sufficiently ionized to remove or reduce static charge from the passing material.

12. A protective ionizing laminate (PIL) static eliminating device that comprises:

a) an insulative or anti-static substrate;

b) a plurality of electrically conductive or static dissipative printed lines, wherein the plurality of electrically conductive printed lines forms a pattern of conductive or static dissipative printed lines;

c) a ground in communication with the electrically conductive or static dissipative printed lines;

wherein the electrically conductive or static dissipative printed lines and at least a portion of the ground are positioned within the insulative or anti-static substrate to form an enclosure; and d) an edge cut into the enclosure exposing the plurality of electrically conductive or static dissipative printed lines to create an edge of ionizing points, to thereby obtain a PIL static eliminating device, wherein the plurality of electrically conductive or static dissipative printed lines is encased by the insulative or anti-static substrate except for the edge of ionizing points, wherein the diameter of the ionizing points ranges from between about 100 nm to 50 μm;

wherein air between the ionizing points and charged material passing by or near the PIL static eliminating device is sufficiently ionized to remove or reduce static charge from said material.

13. The PIL of claim 12, wherein the electrically conductive or static dissipative printed lines are made from inks and jetted materials.

14. A protective ionizing laminate (PIL) static eliminating device for attachment to a second device or machine, that comprises:

a) at least one laminate layer having a thickness ranging between about 5 μm to about 300 μm;

b) a plurality of electrically conductive or static dissipative material or microfibers, wherein the plurality of electrically conductive material or microfibers forms a pattern;

c) a ground in communication with the electrically conductive or static dissipative material or microfibers;

wherein the at least one laminate layer is adhered to the second device or machine with the electrically conductive or static dissipative material or microfibers and at least a portion of the ground positioned there between to thereby form a laminated enclosure; and d) an edge cut into the laminated enclosure exposing the plurality of electrically conductive or static dissipative material or microfibers to create an edge of ionizing points, to thereby obtain a PIL static eliminating device, wherein the plurality of electrically conductive or static dissipative material or microfibers is encased by the laminate layer adhered to the second device or machine except for the edge of ionizing points, wherein the diameter of the ionizing points ranges from between about 100 nm to 50 μm;

wherein air between the ionizing points and charged material passing by or near the PIL static eliminating device is sufficiently ionized to remove or reduce static charge from the passing material.

15. An apparatus through which insulative material flows or is propelled, the apparatus includes:

a) a static eliminating device that comprises:

i) at least two laminate layers comprising a first laminate layer and a second laminate layer, wherein the first laminate layer, the second laminate layer, or both has a thickness ranging between about 5 μm to about 300 μm;

ii) a plurality of electrically conductive or static dissipative materials or microfibers, wherein the plurality of electrically conductive material or microfibers forms a pattern;

iii) a ground in communication with the electrically conductive or static dissipative material or microfibers;

wherein the at least two laminate layers are laminated together with the electrically conductive or static dissipative material or microfibers and at least a portion of the ground positioned there between to thereby form a laminated enclosure; and iv) an edge cut into the laminated enclosure exposing the plurality of electrically conductive or static dissipative material or microfibers to create an edge of ionizing points, to thereby obtain a PIL static eliminating device, wherein the plurality of electrically conductive or static dissipative material or microfibers is encased by the two laminate layers except for the edge of ionizing points,. wherein the diameter of the ionizing points ranges from between about 100 nm to 50 μm;

wherein air between the ionizing points and charged material passing by or near the PIL static eliminating device is sufficiently ionized to remove or reduce static charge from the passing material; and b) the apparatus, adapted to receive the static eliminating device, wherein the static eliminating device is positioned proximal to or on a surface at which insulative material flows or propels.

16. A system that provides a protective ionizing surface, the system comprises:

a) an apparatus through which insulative material flows or is propelled and is adapted to receive a static eliminating device; and b) the static eliminating device that comprises:

i) at least two laminate layers comprising a first laminate layer and a second laminate layer, wherein the first laminate layer, the second laminate layer, or both has a thickness ranging between about 5 μm to about 300 μm;

ii) a plurality of electrically conductive or static dissipative material or microfibers, wherein the plurality of electrically conductive material or microfibers forms a pattern;

iii) a ground in communication with the electrically conductive or static dissipative material or microfibers;

wherein the at least two laminate layers are laminated together with the electrically conductive or static dissipative material or microfibers and at least a portion of the ground positioned there between to thereby form a laminated enclosure; and iv) an edge into the laminated enclosure exposing the plurality of electrically conductive or static dissipative material or microfibers to create an edge of ionizing points, to thereby obtain a PIL static eliminating device, wherein the plurality of electrically conductive or static dissipative material or microfibers is encased by the two laminate layers except for the edge of ionizing points, wherein the diameter of the ionizing points ranges from between about 100 nm to 50 μm;

wherein air between the ionizing points and charged material passing by or near the PIL static eliminating device is sufficiently ionized to remove or reduce static charge from the passing material; and wherein the device is positioned proximal to or on a surface at which insulative material flows or propels.

17. A method for removing static charge or reducing static charge on a surface of insulative material, the method comprises:

subjecting the static charge to a static eliminating device that comprises:

i) at least two laminate layers comprising a first laminate layer and a second laminate layer, wherein the first laminate layer, the second laminate layer, or both has a thickness ranging between about 5 μm to about 300 μm;

ii) a plurality of electrically conductive or static dissipative material or microfibers, wherein the plurality of electrically conductive material or microfibers forms a pattern;

iii) a ground in communication with the electrically conductive or static dissipative material or microfibers;

wherein the at least two laminate layers are laminated together with the electrically conductive or static dissipative material or microfibers and at least a portion of the ground positioned there between to thereby form a laminated enclosure; and iv) an edge cut into the laminated enclosure exposing the plurality of electrically conductive or static dissipative material or microfibers to create an edge of ionizing points, to thereby obtain a PIL static eliminating device, wherein the plurality of electrically conductive or static dissipative material or microfibers is encased by the two laminate layers except for the edge of ionizing points, wherein the diameter of the ionizing points ranges from between about 100 nm to 50 μm;

wherein air between the ionizing points and charged material passing by or near the PIL static eliminating device is sufficiently ionized to remove or reduce static charge from the passing material.

18. The method of claim 17, further including positioning the static eliminating device underneath or proximal to insulative material being propelled.

19. A static eliminating device kit for installation on a machine or apparatus, the kit comprises:

a) a first laminate layer having a first protective surface and a first adhesive surface with an adhesive coating, wherein the first laminate layer has a thickness ranging between about 5 μm to about 300 μm;

b) a plurality of electrically conductive or static dissipative material or microfibers attached to the first adhesive surface of the first laminate layer, wherein the plurality of electrically conductive or static dissipative material or microfibers forms a pattern;

c) a ground in communication with the electrically conductive or static dissipative material or microfibers and covered in part with a release liner;

d) a second laminate layer having a second protective surface and a second lamination surface; wherein the second laminate layer has a thickness ranging between about 5 μm to about 300 μm and wherein the first adhesive surface and the second lamination surface are attached to one another with the electrically conductive or static dissipative material or microfibers and at least a portion of the ground positioned there between to thereby form a laminated enclosure;

e) an edge cut into the laminated enclosure exposing the plurality of electrically conductive or static dissipative material or microfibers to create an edge of ionizing points to thereby obtain a protective ionizing laminate static eliminating device, wherein the plurality of electrically conductive or static dissipative material or microfibers is encased by the first laminate layer and the second laminate layer except for the edge of ionizing points, wherein the diameter of the ionizing points ranges from between about 100 nm to 50 μm;

wherein when the PIL static eliminating device is installed, the release liner is removed from the ground and is placed on the machine or apparatus; and wherein when in use air between the ionizing points and charged material passing by or near the protective ionizing laminate static eliminating device is sufficiently ionized to remove or reduce static charge from the passing material.

20. A static eliminating device kit for installation on a machine or apparatus, the kit comprises:

a) A protective ionizing laminate (PIL) static eliminating device that comprises:

i) at least two laminate layers comprising a first laminate layer and a second laminate layer, wherein the first laminate layer, the second laminate layer, or both has a thickness ranging between about 5 μm to about 300 μm;

ii) a plurality of electrically conductive or static dissipative material or microfibers, wherein the plurality of electrically conductive material or microfibers forms a pattern;

iii) a ground in communication with the electrically conductive or static dissipative material or microfibers; wherein the at least two laminate layers are laminated together with the electrically conductive or static dissipative material or microfibers and at least a portion of the ground positioned there between to thereby form a laminated enclosure; and iv) an edge cut into the laminated enclosure exposing the plurality of electrically conductive or static dissipative material or microfibers to create an edge of ionizing points, to thereby obtain a PIL static eliminating device, wherein the plurality of electrically conductive or static dissipative material or microfibers is encased by the two laminate layers except for the edge of ionizing points, wherein the diameter of the ionizing points ranges from between about 100 nm to 50 μm;

wherein air between the ionizing points and charged material passing by or near the PIL static eliminating device is sufficiently ionized to remove or reduce static charge from the passing material; and b) a laminating material for laminating the at least two laminate layers.

* * * * *